US005430471A

United States Patent [19]

Nakajima et al.

[11] Patent Number: 5,430,471

[45] Date of Patent: Jul. 4, 1995

[54] LIQUID CONTAINER, RECORDING HEAD USING SAME AND RECORDING APPARATUS USING SAME

[75] Inventors: Kazuhiro Nakajima; Yasuo Kotaki; Masanori Takenouchi, all of Yokohama; Toshihiko Ujita, Yamato; Torachika Osada, Yokohama; Hidemi Kubota, Komae; Keiichiro Tsukuda, Kawasaki; Yohei Sato, Yokohama, all of Japan

[73] Assignee: Canon Kabushiki Kaisha, Tokyo, Japan

[21] Appl. No.: 934,327

[22] Filed: Aug. 25, 1992

[30] Foreign Application Priority Data

Aug. 30, 1991 [JP] Japan ..... 3-244908

[51] Int. Cl.[6] ..... B41J 2/175

[52] U.S. Cl. ..... 347/87

[58] Field of Search ..... 347/36, 87, 85

[56] References Cited

U.S. PATENT DOCUMENTS

| | | | |
|---|---|---|---|
| 3,708,798 | 1/1973 | Hildenbrand et al. | 346/140 |
| 4,017,871 | 4/1977 | Hubbard | 346/140 R |
| 4,313,124 | 1/1982 | Hara | 346/140 R |
| 4,345,262 | 8/1982 | Shirato et al. | 346/140 R |
| 4,419,678 | 12/1983 | Kasugayama et al. | 347/86 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,794,409 | 12/1988 | Cowger et al. | 346/140 R |
| 4,878,069 | 10/1989 | Kiyohara | 346/140 R |
| 4,920,362 | 4/1990 | Cowger | 346/140 R |
| 5,138,344 | 8/1992 | Ujita | 346/140 R |
| 5,182,581 | 1/1993 | Kashimura et al. | 347/87 |

FOREIGN PATENT DOCUMENTS

| | | |
|---|---|---|
| 0393320 | 10/1990 | European Pat. Off. . |
| 0488829 | 6/1992 | European Pat. Off. . |
| 4007591 | 9/1991 | Germany . |
| 54-056847 | 5/1979 | Japan . |
| 57-159502 | 10/1982 | Japan . |
| 59-123670 | 7/1984 | Japan . |
| 59-138461 | 8/1984 | Japan . |
| 60-071260 | 4/1985 | Japan . |

*Primary Examiner*—Benjamin R. Fuller
*Assistant Examiner*—N. Le
*Attorney, Agent, or Firm*—Fitzpatrick, Cella, Harper & Scinto

[57] ABSTRACT

A liquid container includes a plurality of chambers, a liquid supply port provided in one of the chambers, an air vent provided in another one of the chambers and a continuous liquid supply material. Adjacent chambers are in fluid communication with each other only through the liquid supply material.

17 Claims, 13 Drawing Sheets

LIQUID CONTAINER, RECORDING HEAD USING SAME AND RECORDING APPARATUS USING SAME

FIELD OF THE INVENTION AND RELATED ART

The present invention relates to a liquid container which permits a required quantity to be taken out therefrom on demand and which is usable as an ink containing device usable in various recording fields, a recording head unit using the same and a recording apparatus using the same.

In such a liquid container, it is desired that the liquid is supplied from the container through a supply port of the container in the amount matching the amount taken out therefrom, and also that the liquid does not leak-out of the container when the liquid is not supplied out of the container. The desire is particularly significant in the case of an ink container for an ink jet recording system in which the recording is effected with the ejection of the ink from a recording head, particularly from the standpoint of the influence to the image quality related to the ink supply amount.

In an attempt to meet the desire, the following proposals have been made.

Referring first to FIG. 22, an ink container of an ink cartridge 201 is filled substantially entirely with a porous material 202 which retains the ink. Adjacent one end of the porous material 202, there is provided an ink supply port 5, which is in communication with a recording head 6 through a supply pipe 11, and adjacent the other end, there is provided an air vent 4.

In the Example of the ink container, the vacuum in the ink container is maintained by the capillary force provided by the porous material 202, so that the ink does not leak out through the ink supply port 5.

However, since the ink is retained in the porous material, the amount of the ink contained in the cartridge or the ink container is small, and in addition, the amount of non-usable ink is also large.

In order to remove the reduction of the volume efficiency due to the use of the porous material in the container, the following ink containers not using the porous material are known.

FIG. 23 shows an example of such a structure. In FIG. 23, which is disclosed in U.S. Pat. No. 4,794,409, a liquid container is used for an ink jet recording head unit having an ink container 206, an overflow sump 203 and a recording head 205 communicating through a porous material 205. In this case, the liquid containing portion 206 does not include the porous material and so the volume efficiency can be increased. The containing portion 206 constitutes a closed space with the exception of a hole 204, through which the liquid is replaced with air with consumption of the liquid, so that the vacuum in the container is maintained to retain the liquid in the container.

However, with the structures shown in FIG. 23, in which a chamber 203 communicating with external air and an ink chamber 208, communicate through a porous material 205, and the ink is supplied externally from the porous material existing in the chamber communicating with the external air, one ink chamber is provided with one hole (204). Therefore, during the ink supply, the ink is supplied to the outside through the porous material and through the hole, and simultaneously, the ink has to be supplied into the ink chamber from a chamber communicating with the external air through the same hole to compensate for the pressure reduction in the ink chamber due to the consumption of the ink.

Since the out-going ink and the in-coming air flow through the same hole and through the same porous material, the flow of the ink and the air are not stable. More particularly, if it occurs for one reason or another that the air line from the chamber communicating with the external air does not continuously extend to the ink chamber but extends directly to the outlet for supplying the ink to the outside, the ink in the ink chamber is no longer able to be taken out because the air flow is easier than the ink flow. This is liable to occur due to impact or vibration applied to the container. Therefore, the liquid supply during use is not stable.

In addition, the ink containers have to be provided with the overflow sump having such a capacity as can guarantee the possible worst ambient conditions, in order to assure safe use even if the air in the ink chamber expands due to the change of the pressure, temperature or the like. In the case the FIG. 23 container, having one ink chamber, the amount of overflow ink is large with the result of a large capacity overflow sump required. This decreases the volume efficiency in the entire ink container.

U.S. Pat. No. 4,920,362 discloses a container which is designed so as to be free from the problem of the liquid and air flow described above. The passage for the incoming air and the passage for the out-going liquid is different. This is shown in FIG. 24, the ink container 1 is divided into three chambers **208*a*, 208*b* and 208*c* by two partition walls 217*a* and 217*b*. The chambers 208*a*, 208*b* and 208*c* communicate with each other through small diameter orifices 12*a* and 12*b* formed in the partition walls 217*a* and 217*b*. The bottom of the first chamber 208*a* communicates with an ink well 219 for supplying the ink to an ink droplet producer 218. The bottom of the third chamber 208*c* communicates with an overflow sump 214 communicating with the external air through a vent 4, through a drop pipe 220 and a bubble creating orifice 12*c*** thereof.

In this ink jet pen, the ink corresponding to the ink amount consumed from the ink droplet producer 218, is supplied to the first chamber **208*a* from the second chamber 208*b* through the orifice 12*a*. To the second chamber 208*b*, the ink is supplied from the third chamber 208*c* through the orifice 12*b*. As a result, the internal pressure of the third chamber 208*c* decreases. When the internal pressure reaches a threshold level, the air is supplied to the third chamber 208*c* through the bubble producing orifice 12*c*, and therefore, the internal pressure of the third chamber 208*c* is automatically controlled, by which the internal pressures of the second and first chambers 208*b* and 208*a*, are controlled. When, on the other hand, the internal pressure of the ink sump 214 increases due to the ambient condition change, the ink flows into the overflow sump 214 through the ink droplet pipe 220, and therefore, the ink does not leak out from the ink droplet producer 218. Since the ink is consumed from the chambers 208*c*, 208*b* and 208*a* in that order, the chamber influenced by the ambient condition is substantially only one of the chambers 208*a*, 208*b* and 208*c***. For this reason, the amount of the overflow ink can be decreased, so that the capacity of the overflow sump can be reduced, thus increasing the volume efficiency of the entire container.

With the structure of FIG. 24 in which a chamber 214 communicating with the external air and an ink chamber 208*c* communicate with each other, and the ink is taken out of the ink chamber 208*c*, that is, the flow passage for the in-coming air and the flow passage for the out-going ink, are different, the air is introduced through a communicating portion 12*c* between the external air and the ink chamber in order to compensate for the pressure reduction in the ink chamber due to the consumption of the ink from the ink chamber during the ink supply action. In the communicating part, only the air is introduced if necessary, and therefore, the instability due to the common passage for the in-coming air and the out-going ink as in the FIG. 23 structure is not present.

However, in FIG. 23, the ink outlet port 225 is spaced apart from the porous material 205 of the communicating portion, and therefore, not all of the ink is used up depending on the pose. More particularly, when the level difference exists between the outlet and the communicating portion, or the pressurized state occurs at the outlet port during the ink supply, the stabilized ink supply is dependent on the pose, or positions of the container.

Similarly to the FIG. 23 structure, the FIG. 24 structure requires a large volume overflow sump with the result of low volume efficiency.

In the structure of FIG. 24, the plural ink chambers communicate with each other through such small size orifices as is able to produce capillary force, and therefore, there is a liability that clogging occurs if the ink contains foreign matter or precipitation. The small diameter orifices have to have such a configuration that the ink does not leak out through the outlet, that both the air and the ink do not flow simultaneously therethrough and that the efficient ink supply is not impeded. Therefore, it involves manufacturing difficulty.

SUMMARY OF THE INVENTION

Accordingly, it is a principal object of the present invention to provide a liquid container, a recording head unit using the same and a recording apparatus using the same in which the liquid can be stably supplied to the outside of the container.

It is another object of the present invention to provide a liquid container, a recording head unit using the same and a recording apparatus using the same in which the ink does not leak out irrespective of the ambient condition change or the pose during use.

It is a further object of the present invention to provide a liquid container, a recording head unit using the same and a recording apparatus using the same in which the latitude of pose of the container during use is large.

It is yet a further object of the present invention to provide a liquid container, a recording head unit and a recording apparatus in which a volume efficiency of the container is large.

It is a yet further object of the present invention to provide a liquid container, a recording head unit using the same and a recording apparatus using the same in which the manufacturing cost and manufacturing difficulty of the container is low.

According to an aspect of the present invention, there is provided a liquid container comprising a plurality of chambers; a liquid Supply port provided in one of said chambers; an air vent provided in another one of said chambers; and a continuous liquid supply material, wherein adjacent ones of said chambers are in fluid communication with each other only through said liquid supply material.

According to another aspect of the present invention, there is provided a recording head unit for effecting recording with ejected ink, comprising an ink container including a plurality of chambers; an ink supply port provided in one of said chambers; an air vent provided in another one of said chambers; a liquid supply material, wherein adjacent ones of said chambers are in fluid communication with each other only through said liquid supply material; a recording head for being supplied with the ink through said supply port; and energy generating means for generating energy contributable to eject the ink.

According to a further aspect of the present invention, there is provide a recording apparatus for effecting recording with ejected ink, comprising: means for mounting an ink container and a recording head, wherein said ink container includes a plurality of chambers; an ink supply port provided in one of said chambers; an air vent provided in another one of said chambers; a continuous liquid supply material, wherein adjacent ones of said chambers are in fluid communication with each other only through said liquid supply material, and wherein said recording head is supplied with ink through the supply port and has energy generating means for generating energy contributable to eject the ink; and means for supplying an electric signal to said energy generating means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
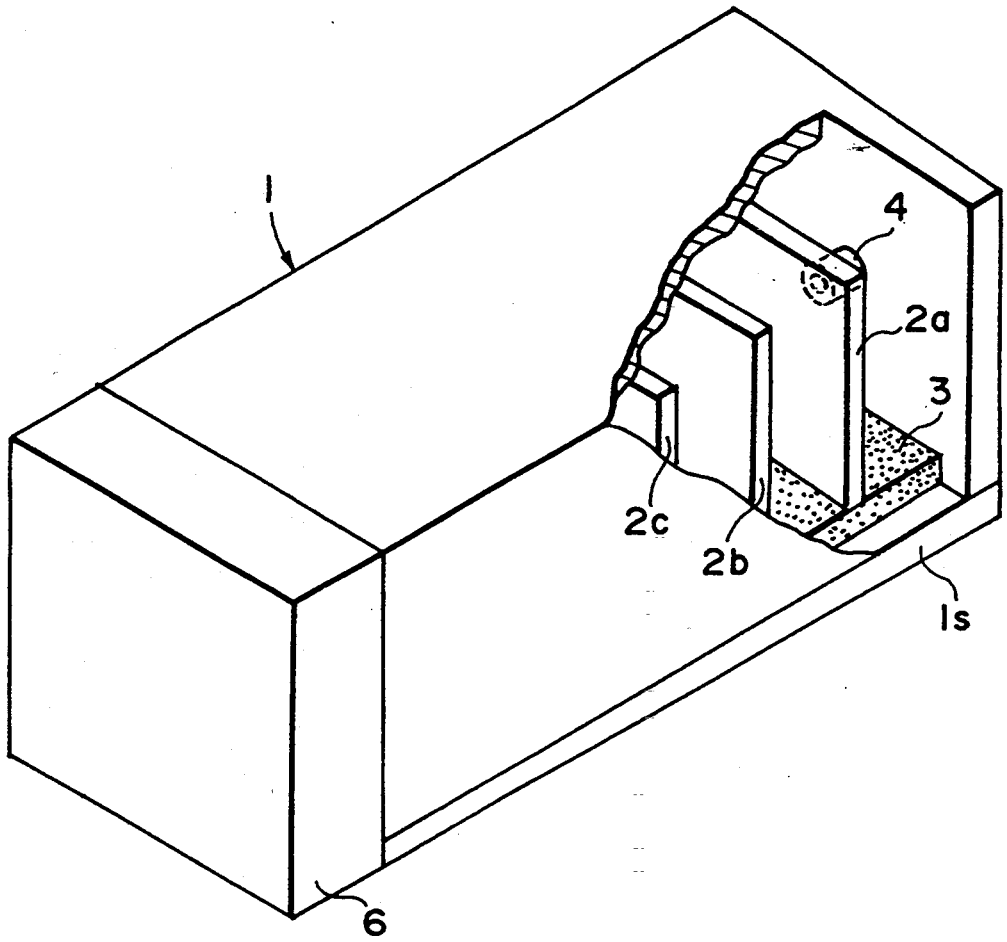
FIG. 1 is a partly exploded perspective view of a liquid container according to an embodiment of the present invention.
Figure 2:
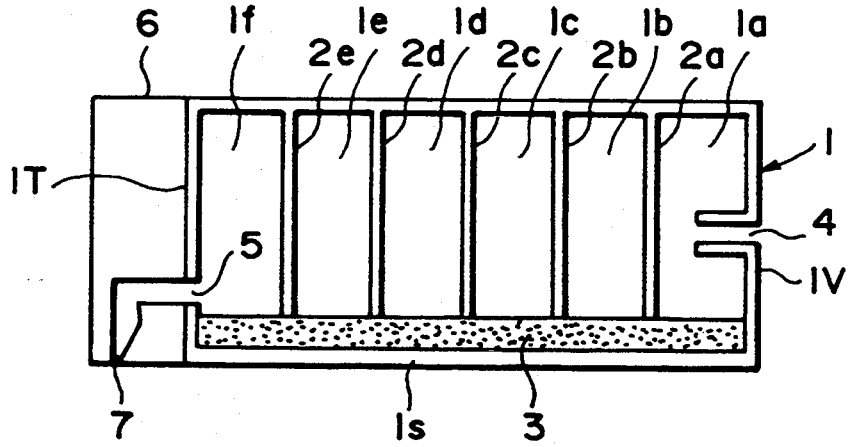
FIG. 2 is a sectional view of a liquid container according to the embodiment of the present invention.

FIG. 1 is a partly broken perspective view of an ink container according to an embodiment of the present invention. FIG. 2 is a longitudinal sectional view of the same ink container. In this embodiment, the liquid container is in the form of an ink container.

In this embodiment, the ink container is used with a recording head which ejects the ink to a recording material such as a sheet of paper. However, the recording head 6 may be a separate member which is mountable to the liquid container.

As shown in FIGS. 1 and 2, the main body 1 of the container is provided with liquid supply material 3 made of porous material (such as sponge or the like) or fibrous material. The portion other than the liquid supply material 3 is divided into six chambers 1*a*, 1*b*, 1*c*, 1*d*, 1*e* and 1*f* by partition plates 2*a*, 2*b*, 2*c*, 2*d* and 2*e* which are formed integrally or separately with the main body 1. The adjacent chambers are in fluid communication only through the liquid supply material 3. An end wall 1T of the container main body 1 is provided with an ink supply port 5 for supplying externally the ink (liquid), and to the same end, a recording head 6 is mounted, the recording head 6 being supplied with the ink through the supply port 5. The end wall is also an end wall of one of the chambers. An end wall of another chamber, that is, a rear wall 1V is provided with an air vent 4. In this embodiment, the air vent 4 is in the form of a pipe and is disposed substantially at the center of the chamber and is extended into the chamber, and therefore, even if the ink is contained in the chamber having the air vent 4, the ink does not leak out irrespective of the pose or position of the ink container if the amount of the ink is not more than one half the volume of the chamber having the air vent 4.

Figure 6A:
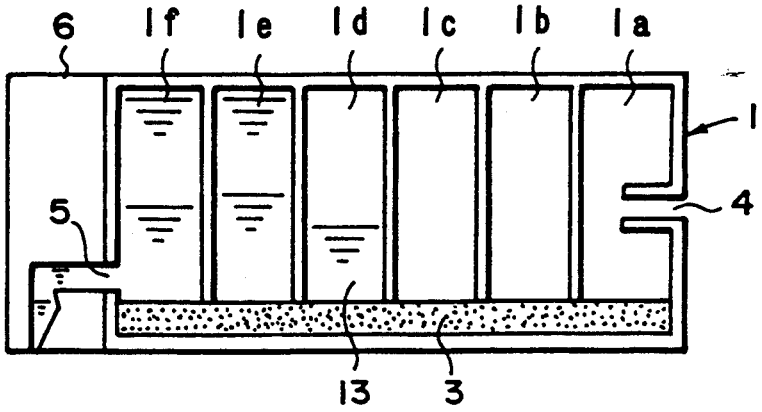
FIGS. 6A, 6B and 6C are sectional views illustrating consumption of the liquid therein.
Figure 6B:
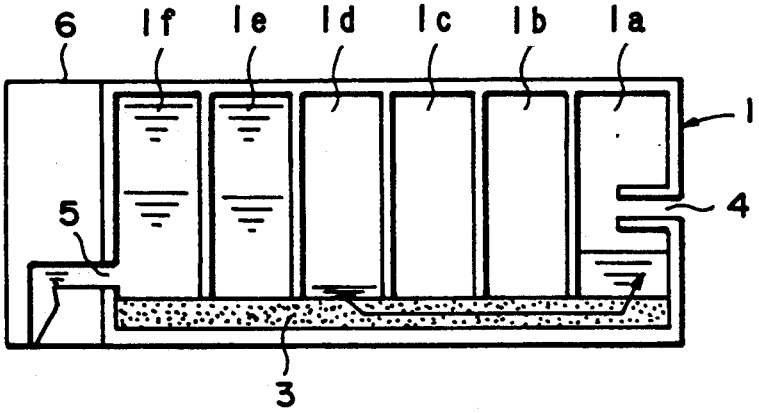
Figure 6C:
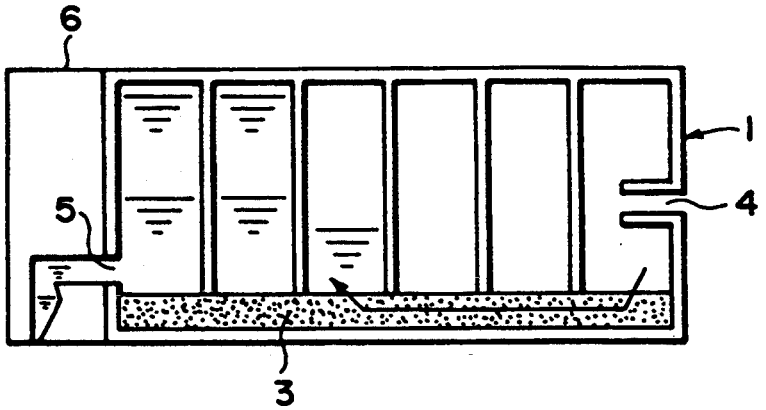

Referring to FIGS. 6A, 6B and 6C, the ink consumption during the recording operation from the ink container of this embodiment will be described. During the recording operation, at least a part of the liquid supply material 3 is at the bottom of the ink container, as shown in FIG. 6A. At the initial stage, the ink container is filled with the ink except for the first chamber having the air vent 4. With the consumption of the ink by the printing operation, the amount of the ink in the chamber most remote from the ink supply port 5, reduces as shown in FIG. 6A. The reason is as follows. With the supply of the ink through the supply port 5, the amount of the ink corresponding to the consumption is discharged from the sixth chamber 1*f* having the supply port 5. Since the sixth chamber communicates with only the fifth chamber 1*e* through the liquid supply material, except for the supply port 5, and therefore, the amount of the ink supplied through the supply port 5 from the sixth chamber 1*f* is supplied into the sixth chamber 1*f* from the fifth chamber 1*e* through the liquid supply material 3. Similarly, the ink is supplied from the air vent 4 side chamber sequentially, so that the ink is supplied continuously through the supply port 5. When there is no ink in the upstream chamber, the air is supplied thereinto through the liquid supply material 3 and through the air vent 4. In this manner, the ink reduces from the upstream chamber. Between such one of emptied chambers as is closest to the supply port 5 and the supply port 5 side adjacent chamber. The flow communication is established through the liquid supply material 3 which contains a great number of fine meniscuses, by means of which the desired vacuum is maintained in the container.

The description will be made as to the ink when the printing operation is not carried out. When the ambient condition, particularly the temperature or the pressure, changes, the volume of the ink (liquid) hardly changes, but the volume of the air in the container significantly changes. For example, when the temperature increases with the state shown in FIG. 6A, the air contained in the first, second and third chambers 1*a*, 1*b* and 1*c*, can be easily discharged to the outside through the air vent 4, because such air is in flow communication through the liquid supply material 3 containing few ink. Therefore, no pressure change due to the air volume change is caused in the recording head. However, the air in the fourth chamber 2*d* is blocked from the external air by the ink 13, and therefore, the ink 13 in the fourth chamber 2*d* is discharged out to the third chamber 1*c* as a result of the expansion of the air in the fourth chamber 1*d*. However, the ink discharged into the third chamber 1*c* seeps through the liquid supply material 3 toward the first chamber 1*a*. During the seeking action, the air in the third and second chambers 1*c* and 1*b* is blocked from the external air. As a result, as shown in FIG. 6B, the discharged air does not hardly enter the third chamber 1*c* or the second chamber 1*b* and moves only to the first chamber 1*a* having the air vent 4.

Thus, the amount of the ink overflown to the first chamber 1*a* is determined depending on the volume increase of the air in the chamber containing both of the ink and the air and on the amount of the ink contained in the same chamber. In this embodiment, only one chamber (chamber 1*d* in FIG. 6A) is isolated from the ambient air, before the temperature increase, and therefore, the volume of the first chamber 1*a* may be determined on the basis of a ratio in consideration of the volume of each of the second and subsequent chambers for the predicted temperature and pressure variation range.

When the temperature decreases, and therefore, the volume of the air decreases, from the state shown in FIG. 6B, the ink having been moved to the first chamber is returned to the fourth chamber 1*d* , because the air in the second, third and fourth chambers 1*b*, 1*c* and 1*d*, are blocked from the ambient air. Ultimately, the state shown in FIG. 6A (initial stage) is restored.

The ink maintaining action when the printing operation is not carried out applies irrespective of the pose of the container. This is because even if almost all of the liquid supply member 3 is above the ink top surface, the ink is movable through the liquid supply material 3 by the capillary force if a part of the liquid supply material is under the top surface of the liquid. However, only when the liquid container is completely upside-down so that the ink in the fourth chamber 1*d* is completely out of contact with the liquid supply material 3, the situation is slightly different. That is, even if the temperature increases, all the air in the ink container is in flow communication with the ambient or external air, and therefore, the ink does not overflow into the first chamber.

As described in the foregoing, according to this embodiment, a chamber having a supply port for supplying the liquid out and a chamber in flow communication with the ambience, is in flow communication only with the liquid supply material. For this reason, even if the ambient condition such as temperature or pressure or the like changes, the ink can be sufficiently supplied to the supply port without the liability of ink leakage. In addition, the latitude of the pose of the ink container is large under the condition that the ink moved to the chamber in flow communication with the ambience due to the external ambient condition can be restored to the original state.

The liquid supply material in this embodiment will suffice if it is stable relative to the liquid contained in the container, and if it is capable of retaining the liquid by the meniscus formed therein and if it is capable of coupling the adjacent chambers for liquid and air communication. Examples of the material include a porous material such as sponge and fibrous material such as felt. From the standpoint of use efficiency of the ink, the porous material is preferable. The liquid supply material is preferably continuous for flow communication between the chamber in communication with the outside air and the chamber provided with the supply port. However, it is not necessarily formed integrally, and from the convenience in the manufacturing thereof, plural liquid supply materials connected are usable.

The partition plates 2*a*–2*e* may be separate members from the main body of the container, but the hermetical sealing is desirably established to prevent the flow communication between adjacent chambers except through the liquid supply material 3. In this embodiment, the number of chambers is 6, but the number is not limited if the same chamber does not have both of the air vent and the supply port. In order to reduce the amount of the liquid flowing back toward the upstream chamber due to the ambient condition change, the provision of a larger number of chambers is desirable. From the standpoint of the stabilized supply of the liquid, the plural chambers are connected in series by the liquid supply material.

In this embodiment, the use of plural chambers permits consumption of the ink sequentially from the chamber having the air vent. Therefore, if at least a part of the container is made of transparent or semi-transparent material, the ink in the container can be observed to be aware of the remaining amount of the ink.

Figure 3:
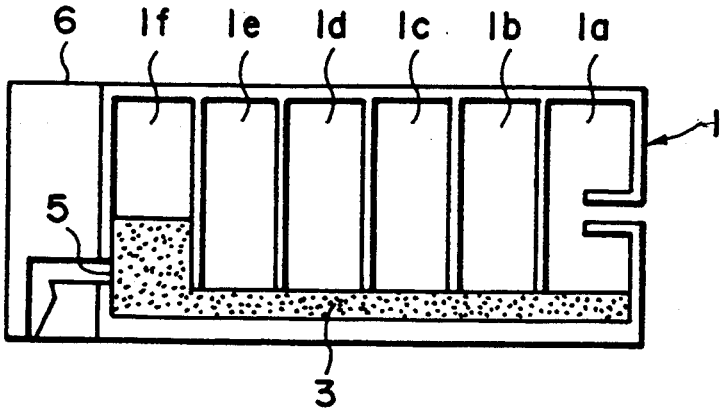
FIG. 3 is a sectional view of a liquid container according to another embodiment of the present invention.

FIG. 3 is a sectional view of a liquid container according to another embodiment of the present invention. The liquid container of this embodiment is different from that of the first embodiment only in that the liquid supply material 3 is extended in the sixth chamber 1*f* to cover the ink supply port 5 to the recording head. Because of this extension of the liquid supply material 3, the remaining ink is assuredly introduced to the supply port.

Figure 4:
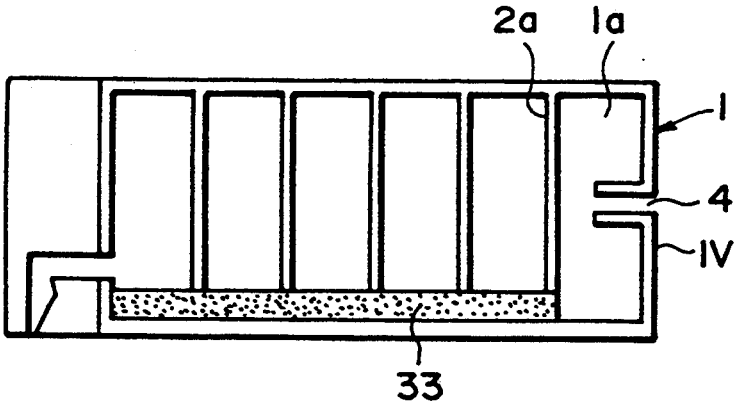
FIG. 4 is a sectional view of a liquid container according to a further embodiment of the present invention.

FIG. 4 is a sectional view of an ink container according to a further embodiment of the present invention. In this embodiment, the liquid supply material 3 is extended only to between the bottom wall of the container main body 1 and the open end of the first partition plate 2*a*. That is, the liquid supply material 3 is not disposed in the first chamber 1*a* defined by the first partition plate 2*a* and the rear end wall 1V having the air vent 4. In the other respects, the ink container of this embodiment is the same as the ink container of the first embodiment.

Figure 5:
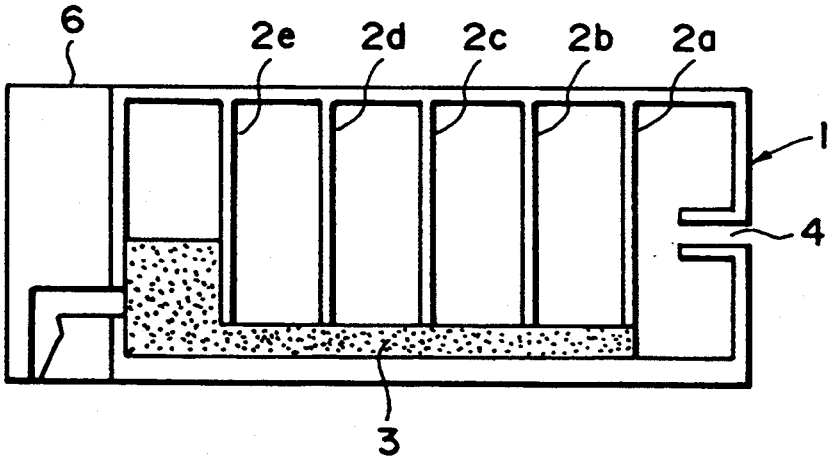
FIG. 5 is a sectional view of a liquid container according to a further embodiment of the present invention.

FIG. 5 is a sectional view of a liquid container according to a further embodiment of the present invention. In this embodiment, the liquid supply material 3 extends only to between the bottom wall of the container main body 1 and the open end of the first partition plate 2*a*, and therefore, it does not exist on the bottom wall of the first chamber. In the other respects, the liquid container of this embodiment is the same as that of the FIG. 3 embodiment. With the present embodiment, the remaining amount of the ink can be reduced, corresponding to the reduced liquid supply material as compared with the FIG. 3 embodiment.

The ink container of this invention may be in the form of a cartridge type which is separate from a recording head. The embodiments of this type will be described.

Figure 7:
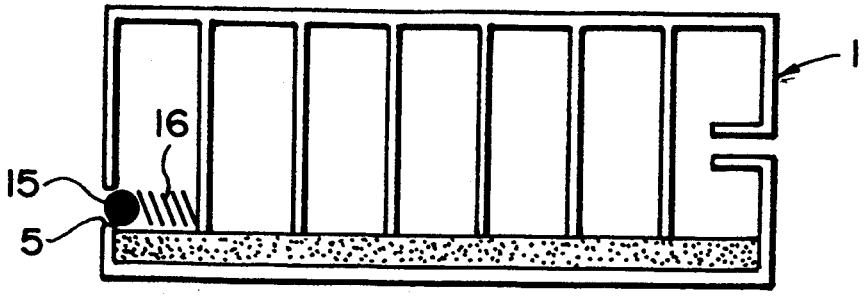
FIG. 7 is a sectional view of a liquid container according to a further embodiment of the present invention.

FIG. 7 is a sectional view of an ink container according to a further embodiment of the present invention. The supply port 5 is closed by a ball 15 normally urged to the supply port 5 by a spring 15. The supply port is opened by a part of the recording head when it is connected thereto.

Figure 8:
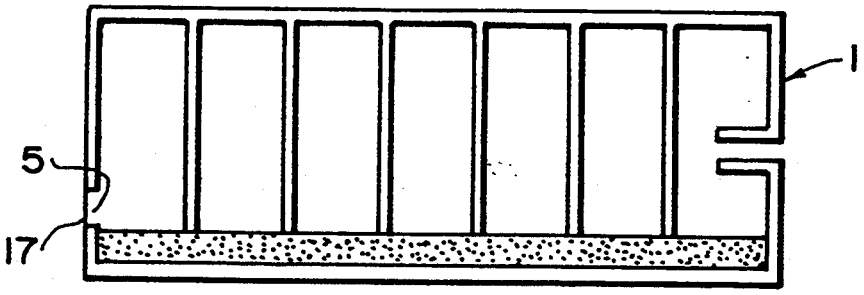
FIG. 8 is a sectional view of a liquid container according to further embodiment of the present invention.

FIG. 8 is a sectional view of an ink container according to a further embodiment of the present invention, and the supply port 5 of the container main body 1 is closed by a sheet 17.

Figure 9:
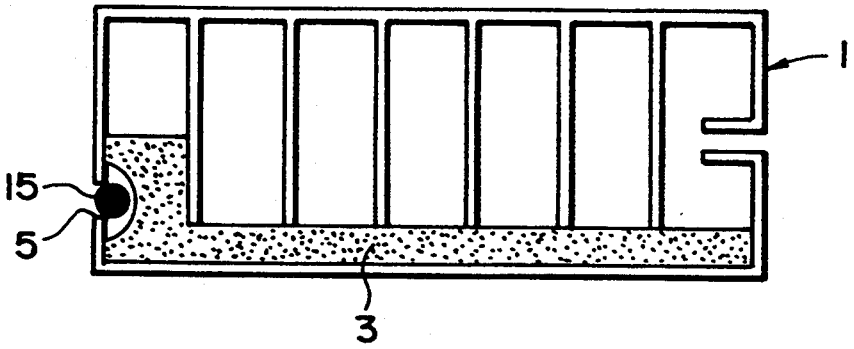
FIG. 9 is a liquid container according to a further embodiment of the present invention.

FIG. 9 is a sectional view of an ink container according to a further embodiment of the present invention. The supply port 5 of the main body of the ink container is closed by a ball 15 which is normally urged to the supply port 5 by the liquid supply material 3 enclosing the supply port 5.

Referring to FIGS. 10A, 10B, 10C, 10D, 10E, 11A, 11B and 11C, the description will be made as to the modifications of the position and configuration of the liquid supply material.

Figure 10A:
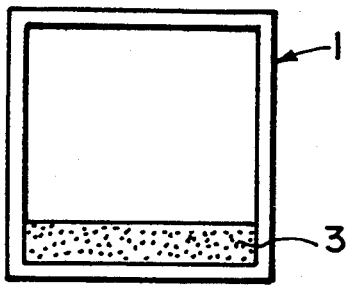
FIGS. 10A, 10B, 10C, 10D and 10E are cross-sectional views of liquid containers illustrating the shape of the liquid supply material and the position thereof in the embodiments of the present invention.

FIG. 10A is a cross-sectional view of a container according to any one of the embodiments described in the foregoing, wherein the liquid supply member has a configuration and is disposed, as shown in FIG. 10A. This is operable except for the upside-down case (the liquid supply material 3 is at the top).

Figure 10B:
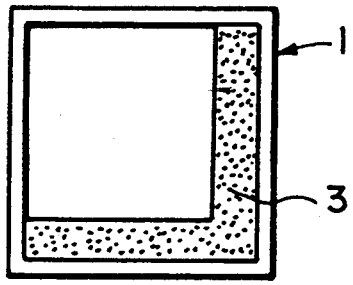

In FIG. 10B, the liquid supply material has an "L" configuration. This is operable with any pose.

Figure 10C:
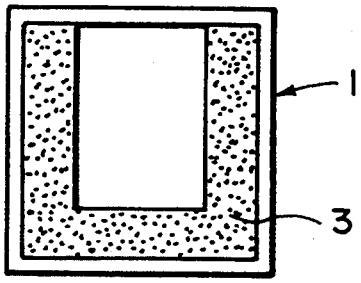

In FIG. 10C, the liquid supply member 3 has a channel like cross-section and the liquid container is operable with any pose.

Figure 10D:
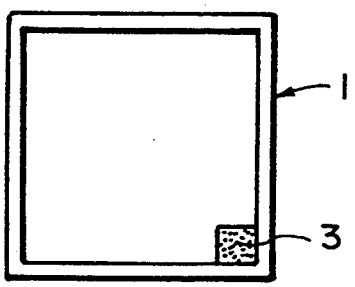

In FIG. 10D, the liquid supply material 3 is in the form of a rod disposed at a corner of the main body of the container 1.

Figure 10E:
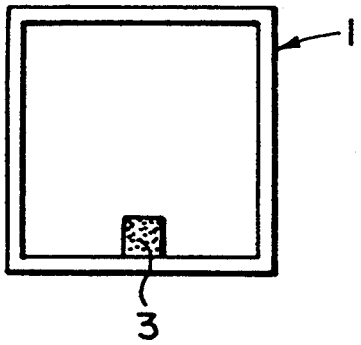

In FIG. 10E, the liquid supply material 3 is in the form of a rod disposed substantially at the center of wall.

From the standpoint of stable ink supply, FIGS. 10A, 10D and 10E arrangements are preferable.

Figure 11A:
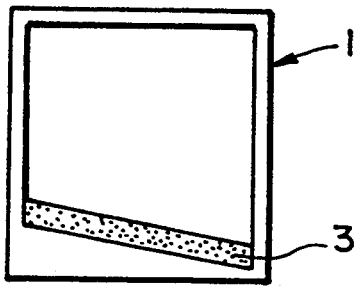
FIGS. 11A, 11B and 11C are cross-sectional views of a container, illustrating the configuration of the liquid supply material and the position thereof.

In FIG. 11A, the bottom surface of the main body 1 of the container is inclined, and the liquid supply material 3 is disposed on the inclined surface.

Figure 11B:
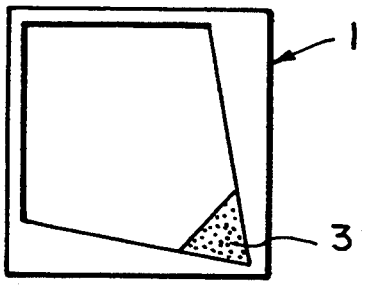

In FIG. 11B, the bottom surface and the right surface of the main body 1 of the container are inclined, and the liquid supply material 3 is disposed at the corner formed by the two inclined surfaces.

Figure 11C:
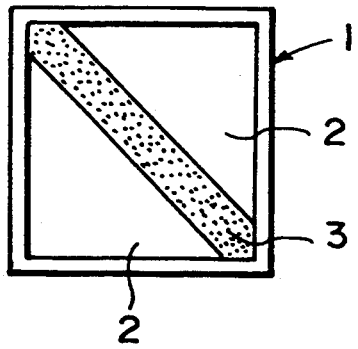

In FIG. 11C, the main body 1 of the container is divided by pairs of triangular partition walls, and the liquid supply material 3 is disposed in the gap between the triangles.

Figure 12:
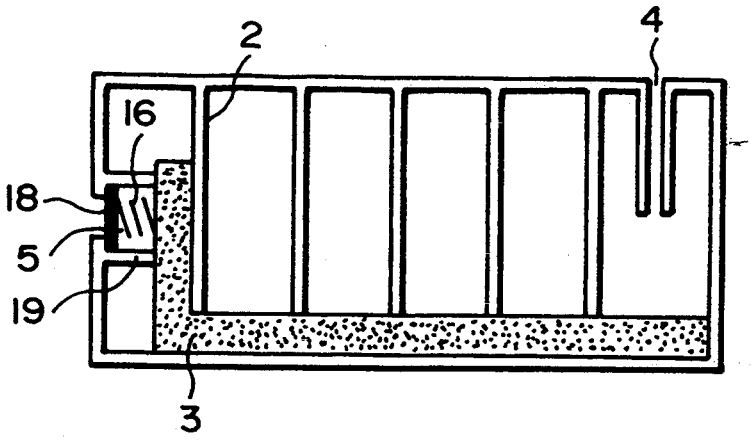
FIG. 12 is a sectional view of a liquid container according to a further embodiment of the present invention.

FIG. 12 is a sectional view of an ink container according to a further embodiment of the present invention. As contrasted to the conventional container, the air vent 4 extends from a wall faced to the surface having the liquid supply material 3 toward the center of the chamber. The air vent functions in the same manner as in the foregoing embodiments. Thus, the air vent may be provided for the convenience of manufacturing or the like.

The structure around the supply port comprises a valve 18 movable back and forth, a spring 16 for urging it and a cylindrical portion containing them. The liquid supply material 3 is sandwiched by the cylindrical portion 19 in which the valve 18 is slidable and the partition wall 2. With this structure, the ink leakage can be assuredly prevented when the ink container is separated from the recording head, and in addition, the ink can be more efficiently taken out by the capillary force of the liquid supply material 3.

Figure 13:
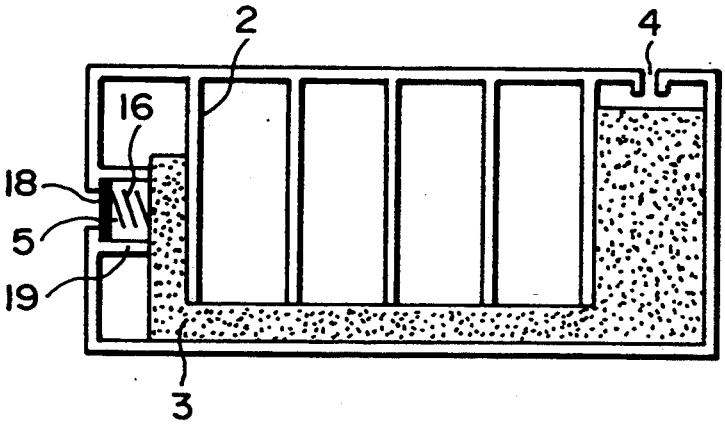
FIG. 13 is a sectional view of a liquid container according to a further embodiment of the present invention.

FIG. 13 is a sectional view of an ink container according to a further embodiment of the present invention. The container of this embodiment is the same as the FIG. 12 embodiment except for the structure around the air vent 4. The chamber opened through the air vent 4 is almost filled with the liquid supply material. The air vent 4 is prevented from contacting the liquid supply material 3 by means of ribs or the like. (not shown). With this structure, the ink is more effectively prevented from leaking out through the air vent 4 by the liquid retaining function of the liquid supply member, even if the container is subjected to vibration or acceleration while the ink is adjacent the air vent 4 due to the temperature or pressure change.

Figure 14:
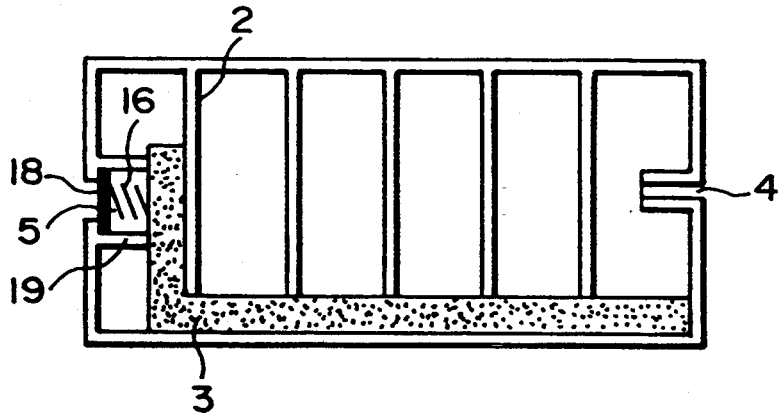
FIG. 14 is a sectional view of a liquid container according to a further embodiment of the present invention.

FIG. 14 is a sectional view of an ink container according to a further embodiment of the present invention. The ink container is the same as FIG. 12 and FIG. 13 embodiments except for the structure around the air vent 4. In this embodiment, the inside opening of the air vent 4 is covered with Fluoro pore (available from SUMITOMO DENKO Kabushiki Kaisha, Japan) fused thereto. The Fluorobore film has the nature that it passes gases therethrough but does not pass the liquid therethrough. Therefore, even if the ink container is subjected to vibration or acceleration under the condition that ink exists in the chamber having the air vent 4 due to the temperature or pressure change, the ink does not leak out. In addition, the ink supply performance of the ink container is not influenced.

The provision of such a film is effective in all of the embodiments of the present invention. The use of the film for the air vent of an ink container has been proposed. However, if it is used while being in contact with the ink at all times, the nature of the film is gradually deteriorated, or if only a part of the outside of the film is wetted, the liquid leaks therethrough. For this reason, it has been difficult to use it practically. According to the present invention, however, the air vent 4 is normally protected from direct contact with the ink, and even if the ink approaches the air vent 4, it contacts the film only when the vibration or the acceleration is imparted to the container. For this reason, the problem with the film can be avoided. In addition, water repelling porous film is advantageously used in this invention. Porous material adjacent the air vent 4 may be integrally formed with the liquid supply material 3, or may be a separate material contacted to the liquid supply material 3. When they are separate materials, the shape of the liquid supply material may be simplified.

Figure 15:
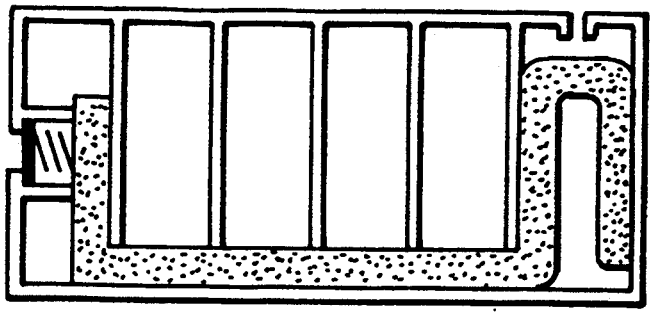
FIG. 15 is a sectional view of a liquid container according to a further embodiment of the present invention.
Figure 16:
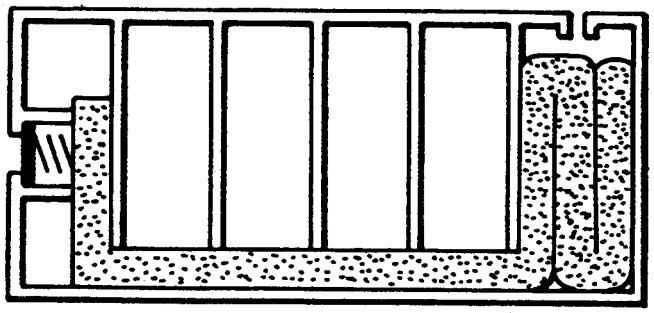
FIG. 16 is a liquid container according to a further embodiment of the present invention.

FIGS. 15 and 16 show other embodiments wherein the arrangement of the liquid supply member adjacent the air vent is different.

As will be understood from the drawing, end portion of the liquid supply material disposed below the partition walls is extended, and the end portion is folded back in a folding fashion properly selected depending on the configuration and the size of the chamber and the thickness of the porous material. With this structure, similarly to the embodiment of FIG. 13, even when the container is subjected to vibration or acceleration while the ink is in the chamber having the air vent due to the temperature or pressure change, the ink is not easily leaked out through the air vent by the liquid retaining action of the porous material.

In FIGS. 13, 15 and 16, the capillary force of the fibrous material or the porous material as the liquid supply member in the chamber having the air vent is generally smaller than the capillary force below the partition walls, by properly selecting the size of the chamber, the quantity of the porous material or the fibrous material and the filling arrangement thereof. Too small of a capillary force is not preferable, since then the ink retaining power for the ink coming to the air vent provided chamber becomes small. It is preferable that the capillary force is 0.2–0.9 time the capillary force below the partition walls.

Figure 17A:
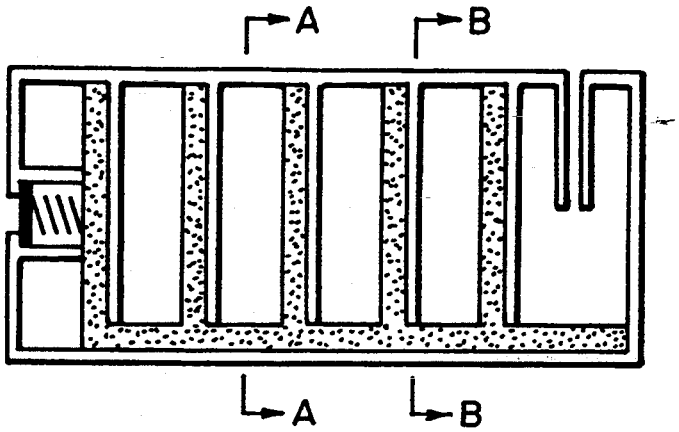
FIG. 17A is a sectional view of a liquid container according to a further embodiment of the present invention.
Figure 17B:
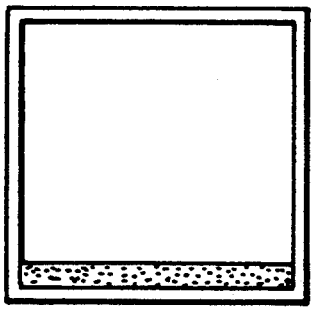
FIG. 17B is a sectional view taken along a line A—A in FIG. 17A.
Figure 17C:
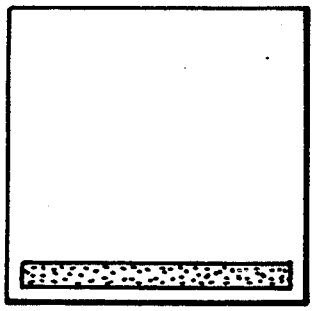
FIG. 17C is a sectional view taken along a line B—B in FIG. 17A.

FIGS. 17A, 17B and 17C show sectional views of an ink container according to a further embodiment of the present invention. In this embodiment, the liquid supply member is extended to the top along each of partition walls. Then, even when the ink container becomes upside-down, the porous material or the fibrous material extended along the partition walls absorbs the ink, and therefore, the ink can be used up.

Figure 18:
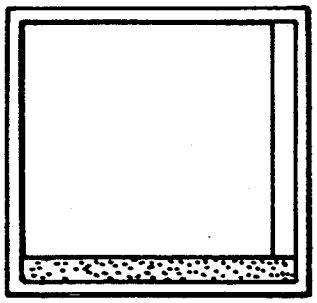
FIG. 18 is a cross-sectional view of a liquid container according to a further embodiment of the present invention.
Figure 19:
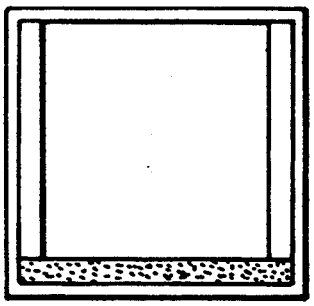
FIG. 19 is a cross-sectional view of a liquid container according to a further embodiment of the present invention.

FIGS. 18 and 19 show modifications of the FIGS. 17A–17C embodiment in which the material extends along a part of the partition wall which provides similar advantageous effects. The FIGS. 18 and 19 arrangements are easier to manufacture.

In the foregoing embodiments, the number of chambers is 6. However, the number may be 2 or more, as described hereinbefore. Since however the chamber having the air vent 4 does not contain the ink in the initial state, the size of that chamber has to be increased to prevent leakage if the number of chambers is small, and therefore, the ink capacity is not very large. If the number of chambers is too large, the volume occupied by the partition walls decreases with the result of low ink capacity. In consideration of these factors, the number of the chambers is properly determined by one skilled in the art.

The volume of each of the chambers may vary, but it is preferable that the chamber having the air vent has a volume which is not less than 0.6 times the volume of the maximum volume chamber. This is because the ink leakage has to be assuredly prevented even when the air in the container expands or contracts as a result of temperature change or pressure change which possibly occurs under the normal ink container use or handling (the pressure in the baggage compartment is approx. 0.7 atom). In order to provide smooth ink supply, the sizes of the chambers are preferably uniform or may be increased toward the supply port.

The description will be made as to the liquid supply material used in the ink container of the present invention.

At least portions of the liquid supply material (porous material or fibrous material) which are under the partition walls preferably have substantially isotropic easiness in the ink seeping.

When a part of the flow path of the porous or fibrous material between adjacent chambers becomes higher than the ink surface because of the position or pose change of the container, a harmful air flow path may be formed due to an impact to the container. Even if this occurs, the ink is absorbed by capillary action from the existing ink, and therefore, the formed air path will be removed, thus permitting liquid supply again. If the liquid supply material has such a nature that the ink does not easily seep along direction in which the edge contacting the liquid supply material extends, an air path, which is once formed in the liquid supply material above the liquid level by impact or the like, is not easily filled back with the liquid, the liquid is not sufficiently supplied to the supply port, and in addition, the liquid flows out to the chamber having the air vent. If this occurs, the ink may leak out through the vent when the container is subjected to the temperature or pressure change.

The preferable porous material constituting the liquid supply material 3 is polyurethane foam material. In an example of the producing method of the polyurethane foam material, polyether polyol, polyisocyanate and water are reacted with foaming material, catalyst, coloring agent or additives, if desired, by which a high polymer material having a great number of pores is produced. This is cut into a desired size (block), and the block is immersed in the ambience of flammable gas. By explosion of the gas, the film materials between the cells are removed. This producing method is preferable for the material used in this invention.

Table 1 shows results of evaluation of various necessary properties of respective ink containers having the porous material (polyether polyurethane foam) having various porosities.

The ink containers evaluated are those of the FIG. 2 embodiment. The porous material continuously extends from the first chamber to the sixth chamber, and is packed between the bottom surfaces of the partition plates 2*a*–2*e* and the bottom surface of the container 1 without clearance therebetween. The packing degree is expressed as a ratio T2/T1 (compression ration: K), where T1 is a distance between the inside bottom surface 1s of the ink container and the bottom surface of the partition plate 2*a*–2*e*, and T2 is a thickness of the porous material before insertion therebetween. The ratio K larger than 1 means the porous material is compressed between the partition plate and the bottom of the ink container, whereas the ratio smaller than 1 means existence of a gap between the porous material and the partition plate or the bottom surface of the ink container. In the latter case, a problem will arise as will be described hereinafter.

When the ratio K is 0.8 at the bottom of the partition plate 2*a*, for example, a gap exists between the partition plate 2*a* and the bottom surface of the ink container, and therefore, the reverse flow of the air and the ink occur. That is, the air flow from the first chamber 1*a* to the second chamber 1*b*, and the ink flow from the second chamber 1*b* to the first chamber 1*a*. If the ambient condition particularly the temperature rise occurs under this condition, the air expands, and the amount of the ink corresponding to the air expansion moves from the second chamber 1*b* to the first chamber 1*a*. If, however, the first chamber already contains the ink, the first chamber comes to contain a sum of the ink, with the possible result that the sum of the ink amount exceeds the capacity of the first chamber, which leads to the leakage of the ink through the air vent 4.

If, on the other hand, the ratio K is too large, the distribution of the porosity P of the porous material inclines, with the possible result of the ink remaining in the porous material.

The porosity P means a number of cells in 1 inch of the porous material. In the evaluation tests, the compression ratio K was 1.5, while the porosity of the porous material was changed, and the porous materials are evaluated in response of ink supply and durability against vibration. In Table 1, "non-compression" means the portion of the porous material where it is not compressed, and it is 7 times as large as the portion which is sandwiched between the partition plate and the bottom plate, as measured in the direction of the ink flow.

(1) Ink supply response

This is indicative of whether a proper amount of ink (not too large and not too small) can be supplied to the recording head connected to the ink container during the recording operation. The recording head had 60 nozzles each ejecting approx. 100 pl, which was operated at the ejection frequency of 4 kHz. All of the 60 nozzles were actuated (solid image printing). In the evaluation tests, when 10 A4 size sheets were recorded, the evaluation was "G"; and when ejection failure occurs before 10 sheets were completed, the evaluation was "N".

(2) Vibration durability

The ink container connected with the same recording head was positioned vertically with the recording head at the bottom, and was vibrated at 2 G/10 Hz for 1 hour. When the ink did not leak through the air vent or the nozzle, the evaluation was "G", and when the leakage occurs, the evaluation was "N".

The air vent was the one directly opening the first chamber 1*a* to the ambience.

TABLE 1

| No. | Pore quantity at non-compression portion (per inch) | Pore quantity at sandwiched portion (per inch) | Performance of porous material | |
|---|---|---|---|---|
| | | | Supply response | Vibration durability |
| 1 | 70 | 105 | G | N |
| 2 | 90 | 135 | G | N |
| 3 | 93 | 140 | G | G |
| 4 | 100 | 150 | G | G |
| 5 | 120 | 180 | G | G |
| 6 | 150 | 225 | G | G |
| 7 | 160 | 240 | G | G |
| 8 | 165 | 248 | G | G |
| 9 | 180 | 270 | G | G |
| 10 | 200 | 300 | G | G |
| 11 | 210 | 315 | N | G |
| 12 | 220 | 330 | N | G |
| 13 | 240 | 360 | N | G |

As will be understood from Table 1, the quantity of pores (per inch) is preferably 140–300.

The description has been made as to the desirability of the provision of the porous material below the partition plates. On the other hand, it is preferable that consideration is paid to the flow passage below the partition plate as follows. If the cross-sectional area of the flow passage before being filled with the porous or fibrous material between adjacent ink chambers is too large, the air can remain with the result that the once formed air path is not easily filled back with the ink. The porous material or the fibrous material which are readily available are considered as an aggregate having various different capillary tubes, if seen microscopically. Therefore, if the cross-sectional area is too small, the difference appears as it is in the difference of the vacuum in the ink supply container. Therefore, the cross-sectional area is preferably approx. 1–100 $mm^2$. However, this is not limiting if the variation of the capillary tubes of the porous material or the fibrous materials are hardly observed.

Such an edge of the partition plate as being press-contacted to the porous material or the fibrous materials (aggregate) and the other portion enclosing the porous material may be a flat surface or may be provided with small projections. As a further alternative, the surfaces may be roughened. By doing so, unintended movement of the porous material or the fibrous material pressed can be avoided.

Figure 20:
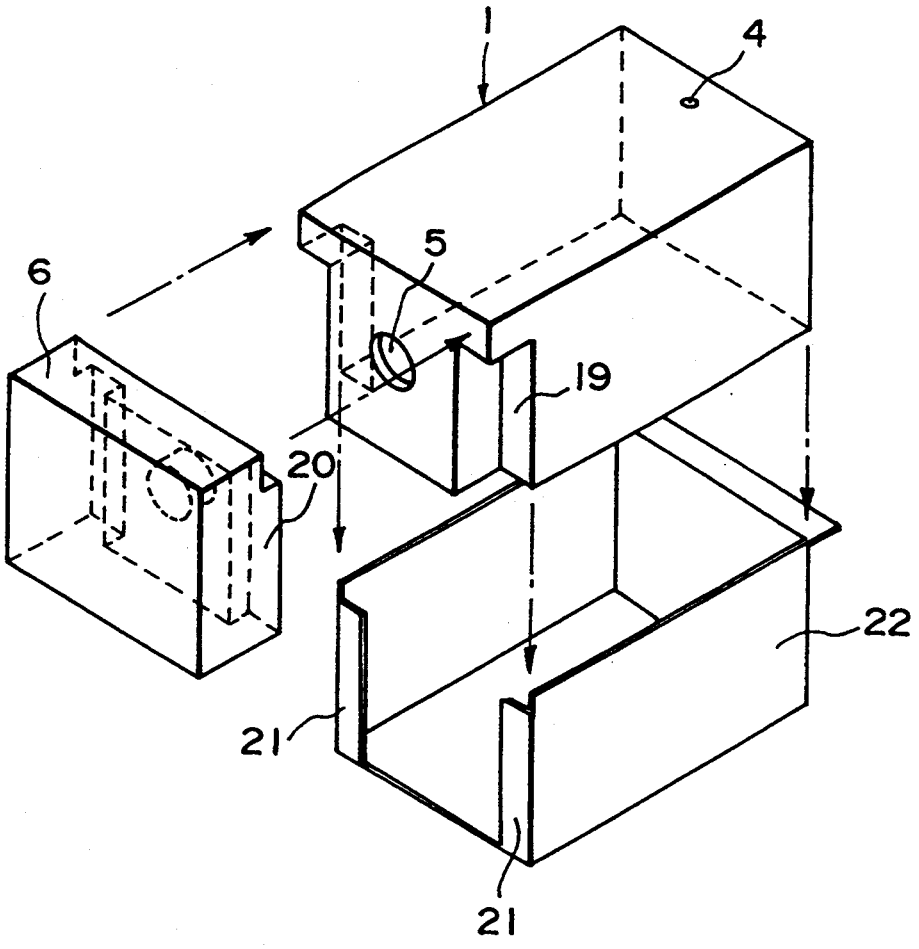
FIG. 20 is a perspective view of mounting means for mounting thereon a liquid container and a recording head.

Referring to FIG. 20, the description will be made as to the mounting means for mounting the liquid container according to this invention and the position or pose confining means. In this Figure, the liquid container of this invention is indicated by a reference numeral 1. It comprises an air vent 4, a supply port 5 and an operating position confining or regulating portion 19. The internal structure of the container is as disclosed in each of the above-described embodiments. An element 6 receives the liquid from the liquid container through the supply port 5. When the liquid container is used as an ink container, the element 6 is a recording head. In the following description, the recording head will be taken. The recording head is provided with positioning means for regulating the position of the liquid container. Mounting means 22 is also provided with positioning means for correctly positioning the liquid container.

As described in the foregoing, the liquid container of this invention is operable in almost any pose of the container, but for the purpose of most stable liquid supply, the liquid supply material is preferably at the bottom. In order to assure such positioning, the positioning portions are effective. As shown in FIG. 20, the position or pose of the liquid container may be determined by the cooperation between the positioning portion of the recording head and the positioning portion of the container. Otherwise, the positioning portion of the mounting means and the positioning portion of the container may be cooperatively used.

Figure 21:
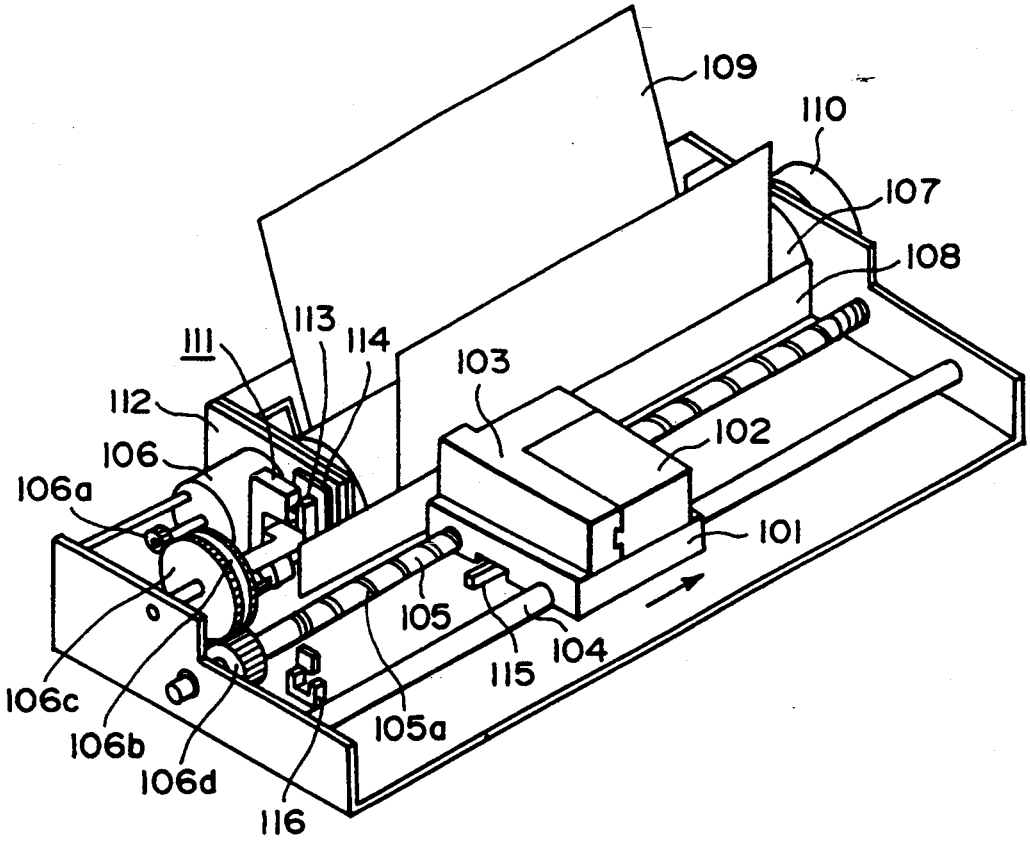
FIG. 21 is a perspective view of an ink jet recording apparatus mounting thereon a liquid container according to an embodiment of the present invention.
Figure 22:
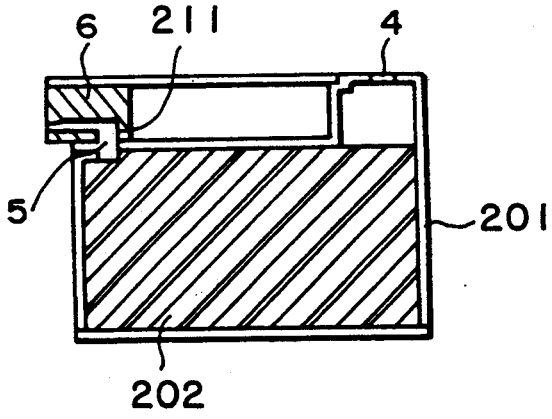
F I G. 22 PRIOR ART
FIG. 22 is a sectional view of a conventional ink container.
Figure 23:
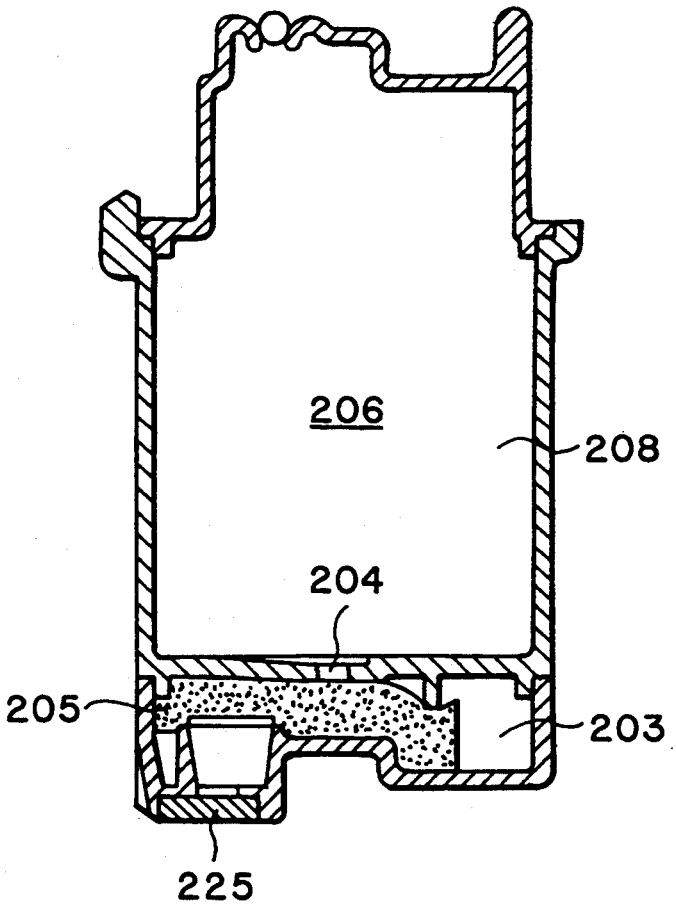
FIG. 23 PRIOR ART
FIG. 23 is a sectional view of another conventional ink container.
Figure 24:
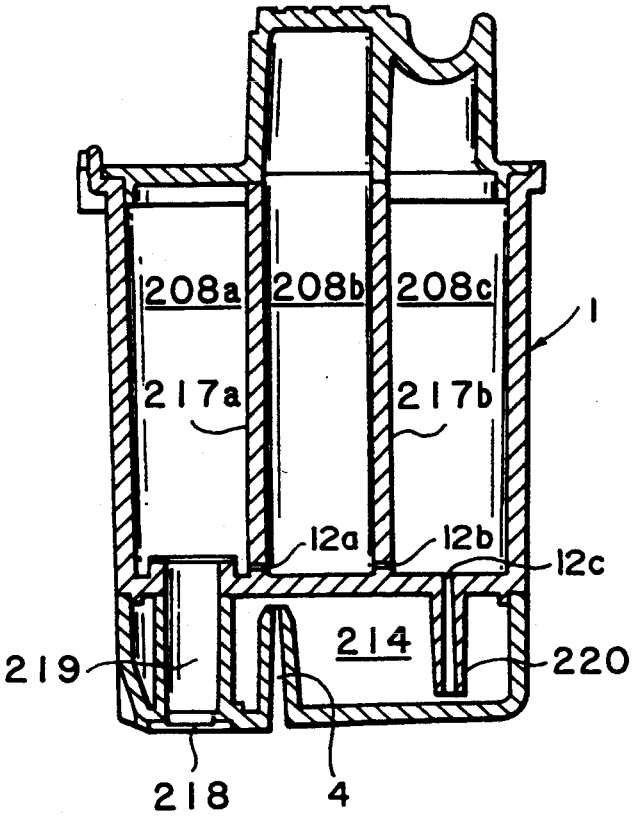
FIG. 24 PRIOR ART
FIG. 24 is a sectional view of a further conventional liquid container.

Referring to FIG. 21, an ink jet recording apparatus using the ink container according to this invention will be described.

The recording head and the ink container according to any one of the embodiments of the present invention are joined so as to constitute a recording head unit. The recording head unit is carried on a cartridge 101 which is guided by a guiding shaft 104 and a leak screw 105 having a helical groove 105*a*. In an alternative arrangement, the ink container according to this invention may be mountable to the recording head. The recording head 103 is provided with a pipe or rod not shown, and when the ink container cassette is mounted, the pipe or rod 7 is inserted into the discharge port of the container to open the discharge port against the spring force of the spring 6 to the ball 5.

The recording head is driven in response to a signal supply means in the recording apparatus.

The lead screw 105 is rotated in the forward and backward directions by a reversible motor 106 through gear trains 106*a*, 106*b*, 106*c* and 106*d*. The carriage 101 is reciprocated in the direction indicated by an arrow and in the opposite direction through an unshown pin of the cartridge 101, the end portion of the pin being in engagement with the helical groove 105*a*, The switching between the forward rotation and the backward rotation of the driving motor 106 is effected in response to detection of the home position of the carriage 101, which is detected by a combination of a lever 105 of the cartridge 101 and a photocoupler 116.

The recording material in the form of a sheet of paper 109 is contacted to a platen 107 by a confining plate 108, and is faced to the recording head by an unshown sheet feeding roller driven by a sheet feeding motor 110.

A recovery unit 111 functions to remove foreign matter deposited on the ejection outlet side of the recording head 103 or viscosity increased ink thereon so as to recover the regular ejection performance.

The recovery unit 111 comprises a capping member 113 in communication with an unshown sucking means and sucks the ink through the ejection outlets of the recording head 103 which is capped to remove the foreign matter and the viscosity increased ink from the neighborhood of the ejection outlets. Between the recovery unit 111 and the platen 107, there is provided a cleaning blade which is movable toward and away from the movement path of the ejection outlet side of the recording head 103, along a guiding member 112. A free end of the cleaning blade 114 is effective to remove the foreign matter and ink droplets deposited on the ejection outlet side surface of the recording head.

The present invention is particularly suitable for use in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquified at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left to prevent the evaporation of the ink. In either of the cases, the application of the recording signal producing thermal energy, the ink is liquified, and the liquified ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as a computer or the like, as a copying apparatus combined with an image reader or the like, or as a facsimile machine having information sending and receiving functions.

As described in the foregoing, according to the present invention, the plural chambers communicate with each other only through a continuous liquid supply material, and therefore, the latitude of the workable position of the liquid container is high without ink leakage due to the ambient condition change or due to the position change. The ink supply is stabilized, and the ink capacity is large as compared with the size of the container, and therefore, the size of the ink container can be reduced.

In addition, the liquid supply material functions also as a filter, and therefore, the flow passage is protected from clogging.

Using the container of this invention, a small size recording apparatus can be provided with stable recording operation. The liquid container can be produced without difficulty, because precision machining (drilling or the like) is not required.

While the invention has been described with reference to the structures disclosed herein, it is not confined to the details set forth and this application is intended to cover such modifications or changes as may come within the purposes of the improvements or the scope of the following claims.

What is claimed is:

1. A liquid container comprising:
a plurality of chambers;
a liquid supply port provided in one of said chambers;
an air vent provided in another one of said chambers;
a communication port for enabling fluid communication between adjacent chambers; and
a continuous liquid supply material disposed in said communication port, wherein adjacent chambers are in fluid communication with each other only through said liquid supply material.

2. A container according to claim 1, wherein said chamber having said liquid supply port and said chamber having said air vent are connected in series with other of said chambers therebetween.

3. A container according to claim 1, wherein said liquid container is partly made of material permitting observation of the liquid therein.

4. A container according to claim 1, 2 or 3, wherein said liquid supply material is a porous material or a fiber aggregate.

5. A container according to claim 1 or 2, wherein said chamber having said air vent is provided with at least one of a porous material or a fiber aggregate.

6. A container according to claim 1 or 2, wherein said liquid supply material is one integral member.

7. A container according to claim 1, further comprising positioning means for positioning said container relative to a mounting structure or relative to an element to which said container is connected.

8. A recording head unit for effecting recording with ejected ink, comprising:
an ink container including a plurality of chambers, an ink supply port provided in one of said chambers, an air vent provided in another one of said chambers, a communication port for enabling fluid communication between adjacent chambers, and a liquid supply material disposed in said communication port, wherein adjacent chambers are in fluid communication with each other only through said liquid supply material;
a recording head supplied with the ink through said supply port to perform recording; and
energy generating means for generating energy for ejecting the ink.

9. A unit according to claim 8, wherein said chamber having said liquid supply port and said chamber having said air vent are connected in series with other of said chambers therebetween.

10. A unit according to claim 8 or 9, wherein said liquid supply material is a porous material or a fiber aggregate.

11. A unit according to claim 8, wherein said ink container and said recording head are separate units.

12. A unit according to claim 11, further comprising positioning means for positioning said ink container relative to said recording head.

13. A recording apparatus for effecting recording with ejected ink, comprising:
an ink container including a plurality of chambers, an ink supply port provided in one of said chambers, an air vent provided in another one of said chambers, a communication port for enabling fluid communication between adjacent chambers, and a continuous liquid supply material disposed in said communication port, wherein adjacent chambers are in fluid communication with each other only through said liquid supply material;
a recording head supplied with ink through said supply port to perform recording;
energy generating means for generating energy for electing the ink;
means for mounting said ink container and said recording head; and
means for supply an electric signal to said energy generating means.

14. An apparatus according to claim 13, wherein said chamber having said liquid supply port and said chamber having said air vent are connected in series with other of said chambers therebetween.

15. An apparatus according to claim 13 or 14, wherein said liquid supply material is a porous material or a fiber aggregate.

16. An apparatus according to claim 13, wherein said ink container and said recording head are separate units.

17. An apparatus according to claim 13 or 16, further comprising first positioning means on said ink container for positioning said ink container and second positioning means on said mounting means for cooperating with said first positioning means on said ink container.

* * * * *

UNITED STATES PATENT AND TRADEMARK OFFICE

CERTIFICATE OF CORRECTION

PATENT NO. : 5,430,471

DATED : July 4, 1995

INVENTOR : KAZUHIRO NAKAJIMA, ET AL.

It is certified that errors appear in the above-identified patent and that said Letters Patent is hereby corrected as shown below:

COLUMN 1

Line 17, "leak-out" should read --leak out--;

Line 32, "11," should read --211,--; and

Line 50, "205" should read --225--.

COLUMN 2

Line 41, "through" (second occurrence) should be deleted.

COLUMN 3

Line 23, "positions" should read --position,--; and

Line 65, "Supply" should read --supply--.

COLUMN 6

Line 20, "port 5," should read --port 5--;

Line 37, "chamber. Between" should read --chamber between--;

Line 54, "few" should read --little--;

Line 57, "2d" should read --1d--; and

Line 59, "2d" should read --1d--.

COLUMN 7

Line 3, "both of" should read --both--.

UNITED STATES PATENT AND TRADEMARK OFFICE

CERTIFICATE OF CORRECTION

PATENT NO. : 5,430,471

DATED : July 4, 1995

INVENTOR : KAZUHIRO NAKAJIMA, ET AL.

It is certified that errors appear in the above-identified patent and that said Letters Patent is hereby corrected as shown below:

COLUMN 8

Line 52, "15." should read --16.--.

COLUMN 9

Line 17, "wall." should read --the wall.--; and

Line 57, "like." should read --like--.

COLUMN 10

Line 1, "Fluoro pore" should read --Fluoropore--;

Line 3, "Fluorobore" should read --Fluoropore--; and

Line 34, "end" should read --the end--.

COLUMN 11

Line 43, "direction" should read --the direction--.

COLUMN 12

Line 10, "plate" should read --plates--.

COLUMN 14

Line 22, "leak" should read --lead--; and

Line 28, "7" should be deleted.

UNITED STATES PATENT AND TRADEMARK OFFICE

CERTIFICATE OF CORRECTION

PATENT NO. : 5,430,471

DATED : July 4, 1995

INVENTOR : KAZUHIRO NAKAJIMA, ET AL.

It is certified that errors appear in the above-identified patent and that said Letters Patent is hereby corrected as shown below:

COLUMN 15

Line 21, "the the" should read --the--; and

Line 53, "head" should read --heads--.

COLUMN 16

Line 25, "is" (first occurrence) should read --in--.

Signed and Sealed this

Twenty-fourth Day of October, 1995

*Attest:*

Bruce Lehman

BRUCE LEHMAN

*Attesting Officer*

*Commissioner of Patents and Trademarks*